US006935992B2

(12) United States Patent
Gehrke

(10) Patent No.: US 6,935,992 B2
(45) Date of Patent: Aug. 30, 2005

(54) LEG ELEVATOR SYSTEM

(75) Inventor: Jon C. Gehrke, Clive, IA (US)

(73) Assignee: Innovative Ellevations, Clive, IA (US)

( * ) Notice: Subject to any disclaimer, the term of this patent is extended or adjusted under 35 U.S.C. 154(b) by 211 days.

(21) Appl. No.: 10/001,125

(22) Filed: Oct. 19, 2001

(65) Prior Publication Data

US 2003/0078144 A1 Apr. 24, 2003

(51) Int. Cl.[7] ..... A63B 22/16

(52) U.S. Cl. ..... 482/146; 482/100; 482/907; 482/908; 482/79

(58) Field of Search ..... 482/146, 147, 482/100–105, 907–908, 79, 142, 92–94, 133–139, 80, 44, 148; 601/24, 35; 602/4, 5, 6, 16, 23, 25, 26, 27, 32, 33, 34, 60–66; 128/25 B, 89 R, 8 OR, DIG. 15, 25 R, 68, 69, 82, 87 R, 94, 845, 876, 877, 869, 882; 272/96; 6/443, 431, 444; 297/438–439

(56) References Cited

U.S. PATENT DOCUMENTS

| | | | | | |
|---|---|---|---|---|---|
| 830,776 | A | * | 9/1906 | Flagg | 5/327 |
| 1,452,915 | A | | 4/1923 | Kennedy | |
| 1,619,685 | A | | 3/1927 | Updegrove | |
| 2,581,110 | A | * | 1/1952 | Kenworthy | 5/327 |
| 3,066,322 | A | * | 12/1962 | Derby | 5/327 |
| 3,957,041 | A | | 5/1976 | Wilder | |
| 4,071,031 | A | | 1/1978 | Lowman | |
| 4,432,108 | A | | 2/1984 | Chapman | |
| 4,692,954 | A | | 9/1987 | Scott, Sr. | |
| D296,932 | S | | 7/1988 | Tranghese | |
| 4,901,385 | A | | 2/1990 | Adolphson | |
| 5,046,487 | A | | 9/1991 | Scott | |
| 5,584,303 | A | | 12/1996 | Walle | |
| 5,725,486 | A | | 3/1998 | Engelman | |
| D410,743 | S | | 6/1999 | Mekjian | |
| 5,954,621 | A | * | 9/1999 | Joutras et al. | 482/114 |
| D424,698 | S | | 5/2000 | Ames | |

* cited by examiner

*Primary Examiner*—Gregory L. Huson
*Assistant Examiner*—L. Amerson
(74) *Attorney, Agent, or Firm*—Brian J. Laurenzo; Jason M. Hunt; Angela Dralle

(57) ABSTRACT

A device for support and elevation of the lower extremities. More specifically, the invention is a leg elevator that provides calibrated, adjustable support for the upper leg, the lower leg and the foot. The leg elevator is adjustable to many different positions through the use of three independent adjustment mechanisms. The upper leg portion of the leg elevator can be adapted to accommodate people that have upper legs of various lengths. The height of the lower leg portion is also adjustable, and the relative angular position of the upper and lower leg can be varied from a generally flat position, to a substantially bent position. The invention can be used to provide elevation for either leg separately or for both legs simultaneously. The leg elevator is lightweight, easily disinfected, and can be collapsed to a relatively flat position for ease in transport and storage.

29 Claims, 9 Drawing Sheets

LEG ELEVATOR SYSTEM

BACKGROUND OF THE INVENTION

The present invention relates to devices used in supporting and elevating the lower extremities. More specifically, the invention is a leg elevator that provides three different calibrated adjustment mechanisms that operate independently of each other. First, the height of the leg elevator can be adjusted to vary the elevation of the extremities. Second, the angle of the relative portions of the leg elevator can be adjusted to a position that corresponds with a patient's knee or hip joint. Third, the leg elevator can be adjusted to accommodate people having a shorter or longer distance between the hip and the knee joint.

After surgery or injuries to the legs or feet, there is a need to elevate the lower extremities to aid in the healing process. Elevation is beneficial to recovery because it reduces or eliminates swelling and fluid build-up (edema). In addition, patients with chronic swelling or lymphoedema may benefit from leg elevation on a permanent basis. Finally, patients suffering from low back pain often benefit from lower leg elevation. Elevation is usually provided in the hospital-setting and is often recommended to patients upon discharge from the hospital. However, the devices currently in use do not satisfactorily meet the need for a leg elevator that is adjustable by three different and independent means and that is practical and effective for use both at home and at the hospital.

There are several devices in the art that are used to support the lower legs. One type of support variation is the foam leg support used in the devices depicted in U.S. Pat. No. 5,046,487 and in U.S. Design Pat. No. 424,698. While these supports are usually inexpensive and can be used in the home setting, the supports are generally not adjustable, thereby limiting the therapeutic value to some patients. In addition, foam devices cannot usually be easily disassembled or collapsed for transport or storage and generally cannot be easily disinfected.

There are also some adjustable leg supports in the art. However, the adjustment mechanisms of these devices generally are limited and provide variance at only one or two different points of the device. A further disadvantage of other leg support devices is that even if they are adjustable, the devices do not allow for independent adjustment of the different parts of the device. For example, in many leg supports, if the angle of the knee is altered, the height of the lower leg must also be changed in a fixed variation according to the angular position at the knee joint. Likewise, if the height of the lower leg is changed, the knee is placed in a different position. This is problematic if the resultant change of position for that portion of the limb is not desired. This type of device is illustrated in U.S. Pat. No. 4,432,108 and in U.S. Pat. No. 1,619,685 which provide support and elevation, but have only one mechanism for adjustment. Thus, the height of the leg is dependent on the angle of the knee. There is no independence of the adjustment mechanisms, and one or both of the leg support angles is determined by the elevation and flexion of the knee joint.

Other devices in the art are neither practical nor effective for home use because they are either too expensive, they are too difficult to adjust or they cannot be easily collapsed for transport and storage. Some known leg supports require the patients remove or lift their legs from the device for adjustment, such as U.S. Pat. No. 1,452,915, which requires the device to be physically lifted to disengage and reposition the device between the pre-formed "slots." This adjustment mechanism is disadvantageous because it is hard for the patients to achieve the repositioning of a limb by themselves. Additionally, repositioning of the device may require raising or moving the leg from a comfortable or therapeutic position, which could cause pain and delay recovery. Other adjustment mechanisms in the art require the use of additional pieces that can be easily misplaced or utilize a sliding mechanism which runs along the base frame in order to adjust the component sections of the devices. For example, U.S. Pat. No. 5,725,486 uses "slabs or wedges" placed under the leg support to adjust the height of the device, and U.S. Pat. No. 3,066,322 and U.S. Pat. No. 830,776 provide adjustable supports wherein the adjustment is provided by sliding the vertical supports along the base frame and locking them in a desired position. Another disadvantage of these adjustment mechanisms is that it is difficult for the patient to vary the height of the support without the help of another person while the leg is engaged in the support device.

The present invention, on the other hand, consists of few parts that are easy to manufacture, to assemble and to operate. The leg elevator allows patients to change the elevation of the leg according to their specific needs. Furthermore, adjustment of the preferred embodiment of the leg elevator of the present invention is easy, allowing the user to move the telescopic legs that comprise the height adjustment mechanism and the upper leg adjustment mechanism and to move the ball-ratchet mechanism of the angle adjustment mechanism without even removing the leg from the leg elevator. Another benefit of the present invention is that the adjustment of the relative angle of the upper leg support and the lower leg support can be accomplished without moving the height adjustment mechanism or the upper leg adjustment mechanism to a new position on the leg elevator base. Furthermore, the points of adjustment of the leg elevator are calibrated and easily reproducible.

The concept of an independently adjustable leg support was suggested in U.S. Pat. No. 4,901,385 which taught the use of two outer panels having a plurality of holes or apertures for receiving support rods that were attached to support panels used for receiving and positioning a leg. The '385 patent teaches that the rods are to be placed into one of a number of holes in the outer support panel grid and secured to the grid with a washer and a threaded fastener positioned on the outside of the grid panels. Thus, while independently adjustable, the adjustment mechanism is complex, and to accommodate persons of various sizes, larger or smaller outer panels with different configurations of grid holes would be required. Other disadvantages of the '385 device include the plurality of pieces that must be assembled and disassembled for use, and the difficulty in reproducing the desired elevation and angles of each component of the leg elevator. The present invention eliminates these problems and provides additional benefits that are readily apparent from the drawings and detailed description of the invention.

Furthermore, the preferred embodiment of the present invention is constructed of lightweight, plastic pipe such as polyvinyl chloride (PVC) pipe, but other materials such as lightweight aluminum material could also be used. The PVC pipe is preferred, though, because the material is inexpensive, so that it is feasible for patients to purchase the device and use it in the home. The plastic pipe also allows for easy disinfection by wiping the device with a surfactant or alcohol. This may be a useful feature if the patient suffers from post-surgical drainage, ulcers, or for multiple users, in general, in a hospital-setting.

Therefore, it is one object of the present invention to provide a leg elevator that allows for adjustment of three different mechanisms independently of one another.

It is an additional object of the invention to provide a limb elevation system that is collapsible, and is lightweight, yet sturdy, for storage and transfer.

Further objects and benefits of the invention are readily apparent from the drawings and the description of the invention.

BRIEF SUMMARY OF THE INVENTION

The present invention provides a leg elevator which supports both the upper and lower leg, as well as the foot, such that the support components are independently and reproducibly adjustable. The present invention also provides a leg elevator that is made of lightweight, easily disinfected material that is collapsible for easy transport and storage.

The embodiment of the present invention results in advantages not provided by leg elevators known in the art. Other objects, features, and advantages of the present invention will be readily appreciated from the following description and appended claims. The description makes reference to the accompanying drawings, which are provided for illustration of the invention. However, such description does not represent the full scope of the invention. The subject matter regarded as the present invention is particularly pointed out and distinctly claimed at the conclusion of the specification.

DETAILED DESCRIPTION OF THE INVENTION

Figure 1:
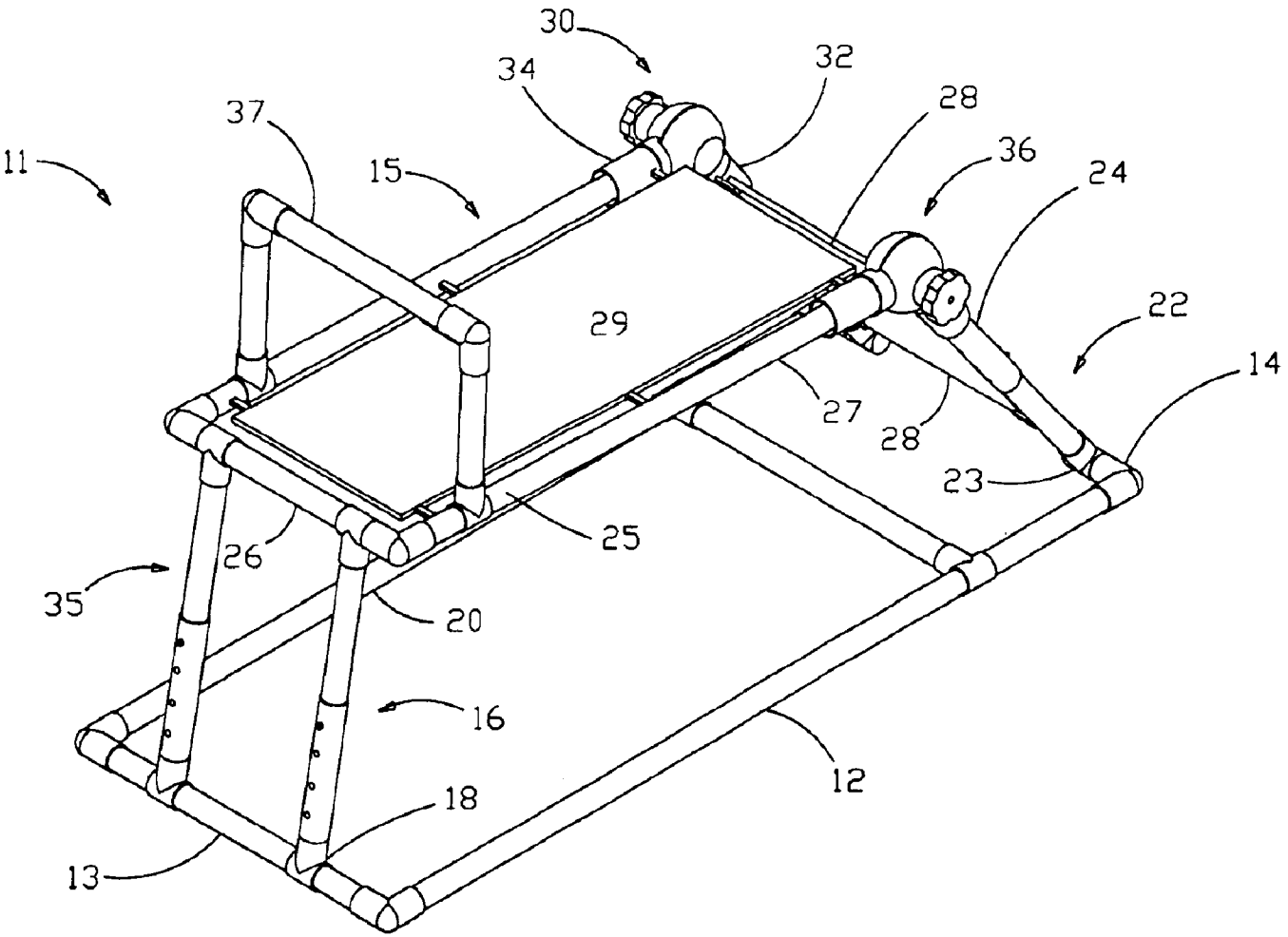
FIG. 1 is a perspective view of the leg elevator.

FIG. 1 shows the leg elevator 11 of the present invention, which is comprised of a base 12, a lower leg support 15, a height adjustment mechanism 16, an upper leg adjustment mechanism 22, an upper leg platform 28, and an angle adjustment mechanism 30. The leg elevator 11 is designed such that when a person is in a sitting or reclining position and the base 12 is on the floor, mattress or other flat surface, the upper leg adjustment mechanism 22 is closer to the person's body than the height adjustment mechanism 16, the upper leg or thigh portion of the person rests on the upper leg platform 28, and the lower leg or calf portion of the person rests on the lower leg support 15, with the angle adjustment mechanism 30 positioned generally under the knee joint of the person.

Referring to FIG. 1, the base 12 of the leg elevator 11 has a lower leg end 13 and an upper leg end 14. The lower leg end 13 of the base 12 is located near the patient's foot and calf portion of the leg when the leg elevator 11 is in use. The upper leg end 14 of the base 12 is located near the thigh portion of the leg when the leg elevator 11 is in use. The lower leg support 15 is adapted to receive the calf portion of the leg when the leg elevator 11 is in use. The lower leg support 15 can be further comprised of a lower leg support frame 25 and a lower leg platform 29 that is connected in an operable manner to lower leg support frame 25. The lower leg support frame 25 has a first end 26 near the lower leg end 13 of the base 12, and the lower leg support frame 25 has a second end 27 near the angle adjustment mechanism 30. The leg elevator 11 also has an upper leg platform 28 that is supported by the upper leg adjustment mechanism 22. The upper leg platform 28 is designed to receive and support the upper leg of the patient when the leg elevator 11 is in use.

Referring still to FIG. 1, the height adjustment mechanism 16 has a first end 18 and a second end 20. The height adjust mechanism 16 is positioned between the lower leg end 13 of the base 12 and the lower leg support 15, such that the first end 18 of the height adjustment mechanism 16 is connected to the lower leg end 13 of the base 12 and the second end 20 of the height adjustment mechanism 16 is attached to the first end 26 of the lower leg support frame 25. The height adjustment mechanism 16 is used to adjust the height of the lower leg support 15 above the base 12. More precisely, the height adjustment mechanism 16 adjusts the height of the first end 26 of the lower leg support frame 25 and the lower leg platform 29 above the lower leg end 13 of the base 12.

The upper leg adjustment mechanism 22 is connected to the upper leg end 14 of the base 12. The upper leg adjustment mechanism 22 has a first end 23 connected to the upper leg end 14 of the base 12 and a second end 24 connected to the angle adjustment mechanism 30. The upper leg adjustment mechanism 16 is used to adjust a distance between the upper leg end 14 of the base 12 and the lower leg support 15, particularly the second end 27 of the lower leg support frame 25 and the lower leg platform 29.

The angle adjustment mechanism 30 has a first end 32 and a second end 34, and the angle adjustment mechanism is positioned between the upper leg adjustment mechanism 22 and the lower leg support 15. More precisely, the first end 32 of the angle adjustment mechanism 30 is connected to the second end 24 of the upper leg adjustment mechanism 22, and the second end 34 of the angle adjustment mechanism 30 is connected to the second end 27 of the lower leg support frame 25. The angle adjustment mechanism 30 is used to adjust the relative angular orientation of the upper leg platform 28 relative to the lower leg support 25, including the lower leg support frame 25 and the lower leg platform 29.

FIG. 1 also shows that in the preferred embodiment, the angle adjustment mechanism 30 is comprised of at least one ball-ratchet mechanism 36, and the height adjustment mechanism 16 is comprised of at least one telescopic leg 35. The upper leg adjustment mechanism 22 is also comprised of at least one telescopic leg 35 in the preferred embodiment of the present invention. A ball-ratchet mechanism 36 and a telescopic leg 35 are described in greater detail in reference to FIGS. 8 and 9 below.

Referring again to FIG. 1, the leg elevator 11 can also include a foot support 37 that is connected to and extends from the lower leg support 15, particularly the lower leg support frame 25 at the first end 26. The foot support 37 is adapted to engage and position the foot when the heel portion of the foot is resting on the lower leg platform 29 of the lower leg support 15 with the toe portion of the foot positioned above the heel portion of the foot. In other words, the ankle is in a flexed position with the heel resting on the lower leg platform 29 and the toes extending up into the air. The foot support 37 is useful in preventing or correcting dorsiflexion (foot drop) of the foot, whereby the foot does not maintain an upright, generally perpendicular position in relation to the rest of the leg, and instead falls to one side so that the toes are pointing sideways instead of upwards. Thus, while the present invention can be used without the foot support 37, the preferred embodiment includes a foot support 37 that keeps the foot at a relatively perpendicular angle to the rest of the leg and that can be removed if desired.

Figure 2:
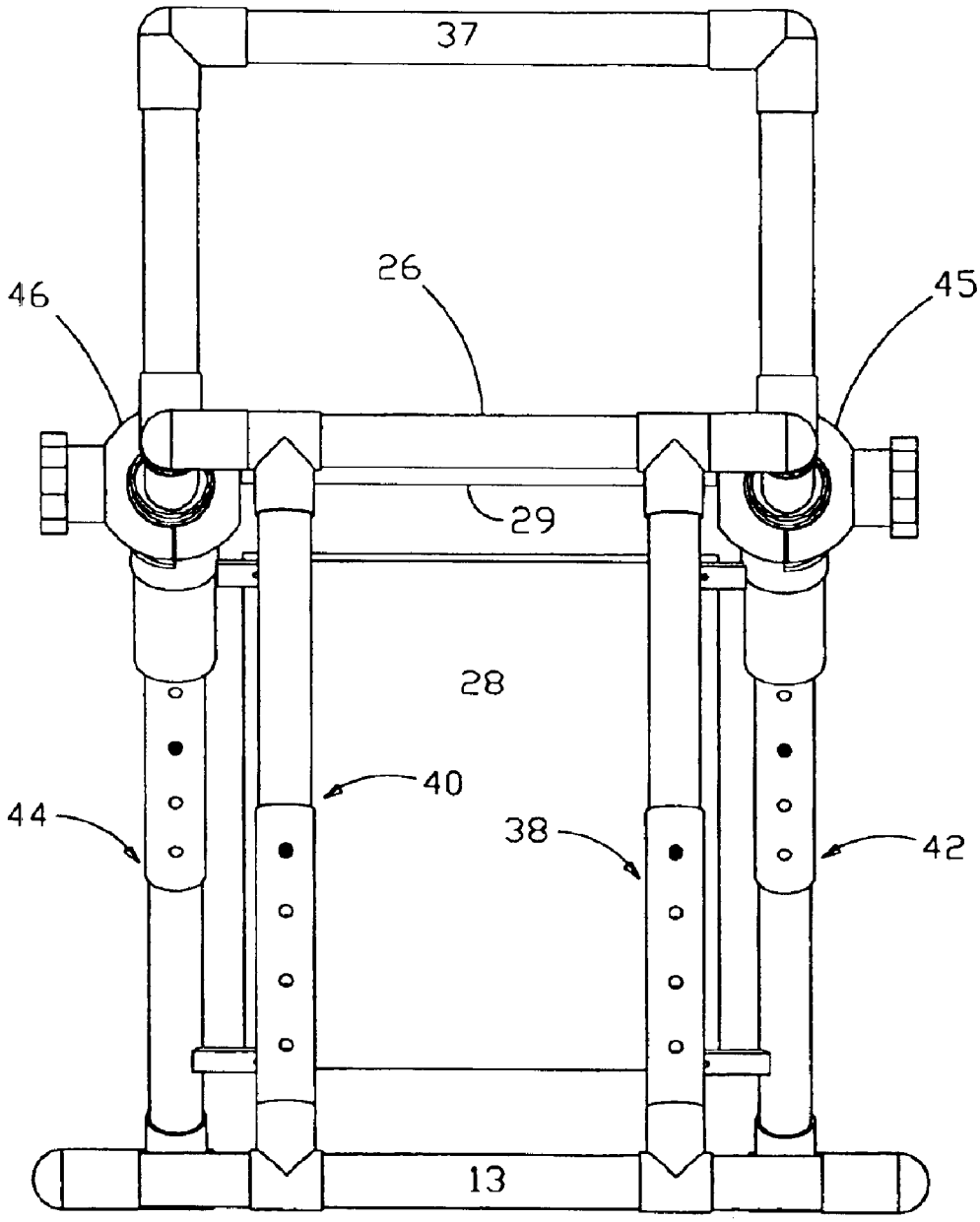
FIG. 2 is an end view of the leg elevator from the lower leg end of the base.

FIG. 2 is an end view of the leg elevator 11 from at position at the lower leg end 13 of the base 12. From the closest portion of the leg elevator 11 depicted in FIG. 2 moving toward the opposite end of the leg elevator 11 in the view, FIG. 2 shows the lower leg end 13 of the base, a first telescopic leg 38, a second telescopic leg 40, the first end 26 of the lower leg support frame 25, the foot support 37, the lower leg support platform 29, a first ball-ratchet mechanism 45, a second ball-ratchet mechanism 46, the upper leg platform 28, a third telescopic leg 42, and a fourth telescopic leg 44.

More specifically, FIG. 2 shows a first telescopic leg 38 between the lower leg end 13 of the base 12 and the first end 26 of the lower support frame 25. A first telescopic leg is used to adjust a height of the lower leg support 15 above the base 12. A second telescopic leg 40 is positioned between the lower leg end 13 of the base 12 and the first end 26 of the lower leg support frame 25. A second telescopic leg 40 is used to adjust the height of the lower leg support 15 above the base 12. A third telescopic leg 42 and a fourth telescopic leg 44 are used to adjust the distance between the upper leg end 14 of the base 12 and the lower leg platform 29 which is attached to the lower leg support frame 25. A third telescopic leg 42 is connected to the upper leg end 14 of the base 12, and a fourth telescopic leg 44 is also connected to the upper leg end 14 of the base 12. FIG. 2 also shows that a first ball-ratchet mechanism 45 is connected between the second end 27 of the lower leg support frame 25 and a third telescopic leg 42. A second ball-ratchet mechanism 46 is connected between the second end 27 of the lower leg support frame 25 and a fourth telescopic leg 44. As shown in FIG. 2, the upper leg platform 28 is operably connected between a third telescopic leg 42 and a fourth telescopic leg 44.

Figure 3:
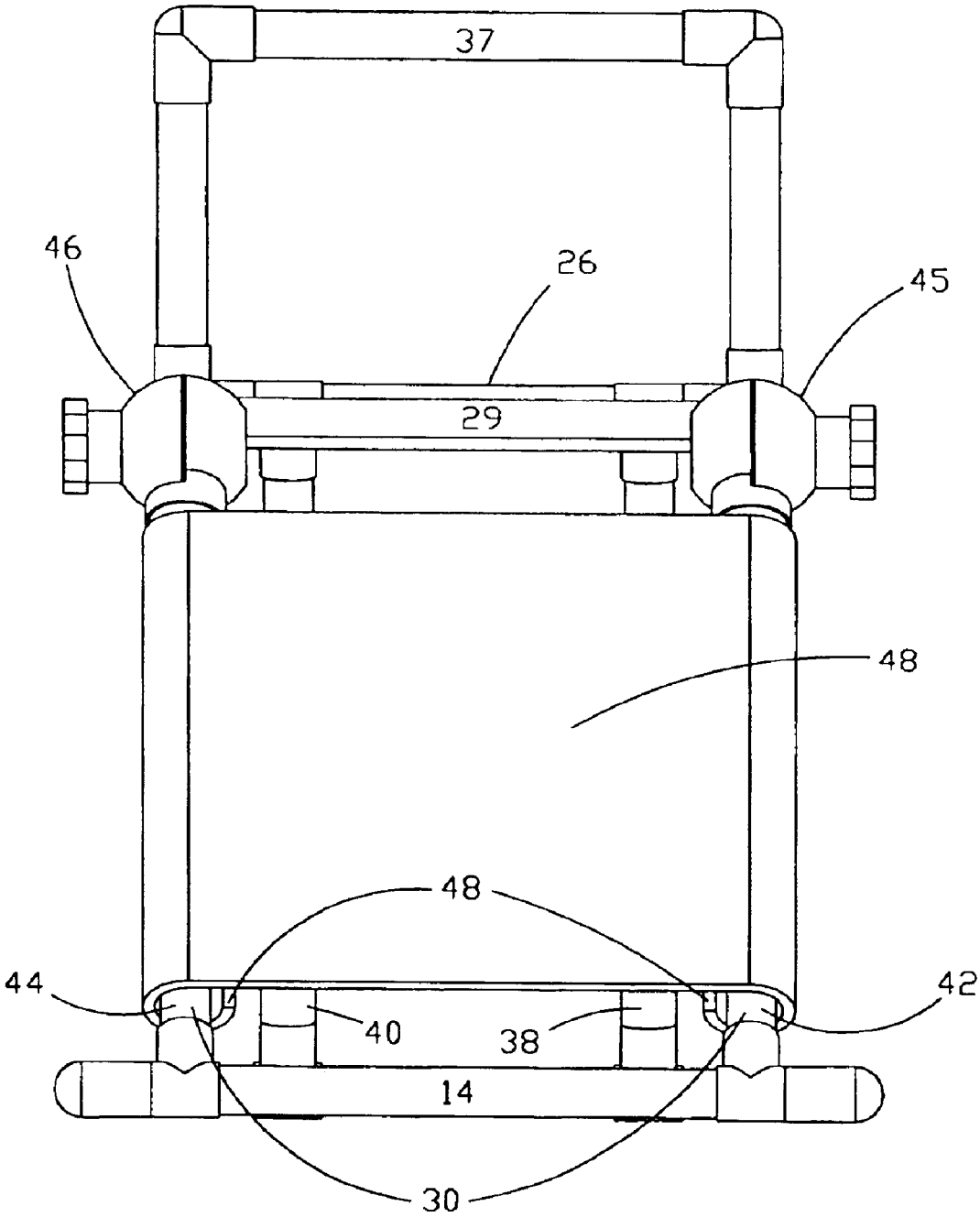
FIG. 3 is an end view of the leg elevator from the upper leg end of the base showing an alternative embodiment of the upper leg platform which uses a length of material forming a sling to receive and support the leg.

FIG. 3 is an end view of the leg elevator 11, looking at the leg elevator 11 from at position at the upper leg end 14 of the base 12. From the closest portion of the leg elevator 11 depicted in FIG. 3 moving toward the opposite end of the leg elevator 11 in the view, FIG. 3 shows the upper leg end 14 of the base, an alternative embodiment of the upper leg platform 28 comprising a length of material 48, a third telescopic leg 42, a fourth telescopic leg 44, a first ball-ratchet mechanism 45, a second ball-ratchet mechanism 46, the lower leg support platform 29, the first end 26 of the lower leg support frame 25, the foot support 37, a first telescopic leg 38 and a second telescopic leg 40.

The upper leg platform 28 can be comprised of a variety of materials. The preferred embodiment shown in FIG. 1 utilizes a substantially rigid material that is formed to receive the leg. However, the upper leg platform 28 can also be comprised of a length of material 48 that is supported by the upper leg adjustment mechanism 22. As shown in FIG. 3, an alternative embodiment of the upper leg platform 28 comprising a length of material 48 that is supported by the upper leg adjustment mechanism 30, forms a sling to receive and support the upper leg portion of the patient using the leg elevator 11. FIG. 2 also shows that the length of material 48 that forms the upper leg platform 28 in the alternative embodiment is connected between a third telescopic leg 42 and a fourth telescopic leg 44 which comprise the upper leg adjustment mechanism 30. Preferably the length of material 48 is adapted such that it wraps around the third telescopic leg 42 and the fourth telescopic leg 44 and attaches to the underside of the length of material 48 that forms the upper leg platform 28 using means such as a hook and loop fabric system commonly referred to as "Velcro."

However, other means of attaching the upper leg platform 28 to the upper leg adjustment mechanism 22 could be utilized with the leg elevator 11. The upper leg platform 28 can be attached to the upper leg adjustment mechanism 22 in any manner that allows the upper leg adjustment mechanism 22 to support the upper leg platform. An alternative attachment mechanisms for the length of material 48 could include snaps or a buttons that are located on the underside of the length of material 48 or snaps or rivets that are located on the upper leg adjustment mechanism 22. If the upper leg platform 28 is of the rigid type, the attachment mechanism could be means such as rivets, clamping devices, or rigid straps that are formed to connect the upper leg platform 28 to the upper leg adjustment mechanism 22.

Figure 4:
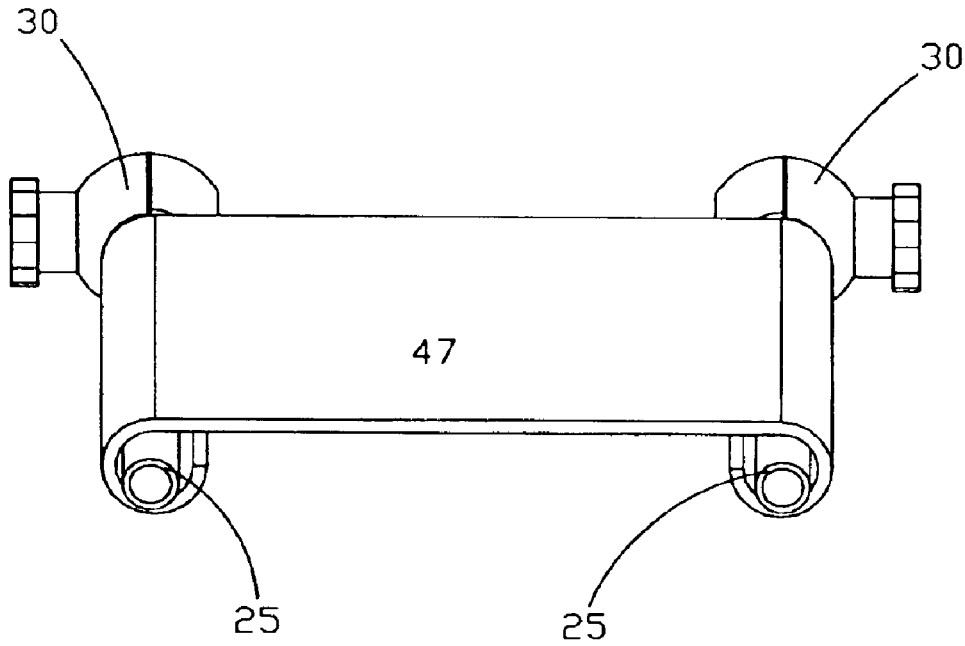
FIG. 4 is cross section of an alternative embodiment of the lower leg platform which uses a length of material forming a sling to receive the leg.

The lower leg platform 29 is similar to the upper leg platform 22 in that the lower leg platform 29 can also be formed of a variety of materials. The lower leg platform 29 is adapted to receive and support the calf portion of the leg. FIG. 4 shows a cross section of the lower leg support frame 25 and an alternative embodiment of the lower leg platform 29 that utilizes a length of material 47 that is suspended from the lower leg support frame 25 and is adapted to form a sling to receive and support the lower leg. FIG. 4 also shows the angle adjustment mechanism 30.

The lower leg platform 29 can be attached to the lower leg support frame 25 by a variety of means that are operable with the leg elevator 11. For example, if the lower leg platform 29 is of the rigid type (as shown in FIGS. 1 and 2), the lower leg platform 29 can be attached to the lower leg support frame 25 by rivets, clamping devices, or straps that are adapted to connect the lower leg platform 29 to the lower leg support frame 25 or to encircle the sides of the lower leg support frame 25. Alternatively, the lower leg support frame 25 and the lower leg platform 29 can be constructed in a manner as to make them a single part of the leg elevator 11, forming a unitary lower leg support 15. Thus, instead of having a separate lower leg platform 29 connected to the lower leg support frame 25, the lower leg support 15 can be formed out of one piece, thereby combining two parts of the leg elevator 11 into a single part and eliminating the need for a means of connecting the lower leg platform 29 to the lower leg support frame 25. Additionally, if the lower leg platform 29 is made of a length of material 47, the material 47 can be adapted to encircle the lower leg support frame 25 and attach to the underside of the length of material 47 or to the lower leg support frame 25 using a hook and loop fabric system such as "Velcro" or by other means such as the snaps or button closure described above in relation to the upper leg platform 28.

Figure 5:
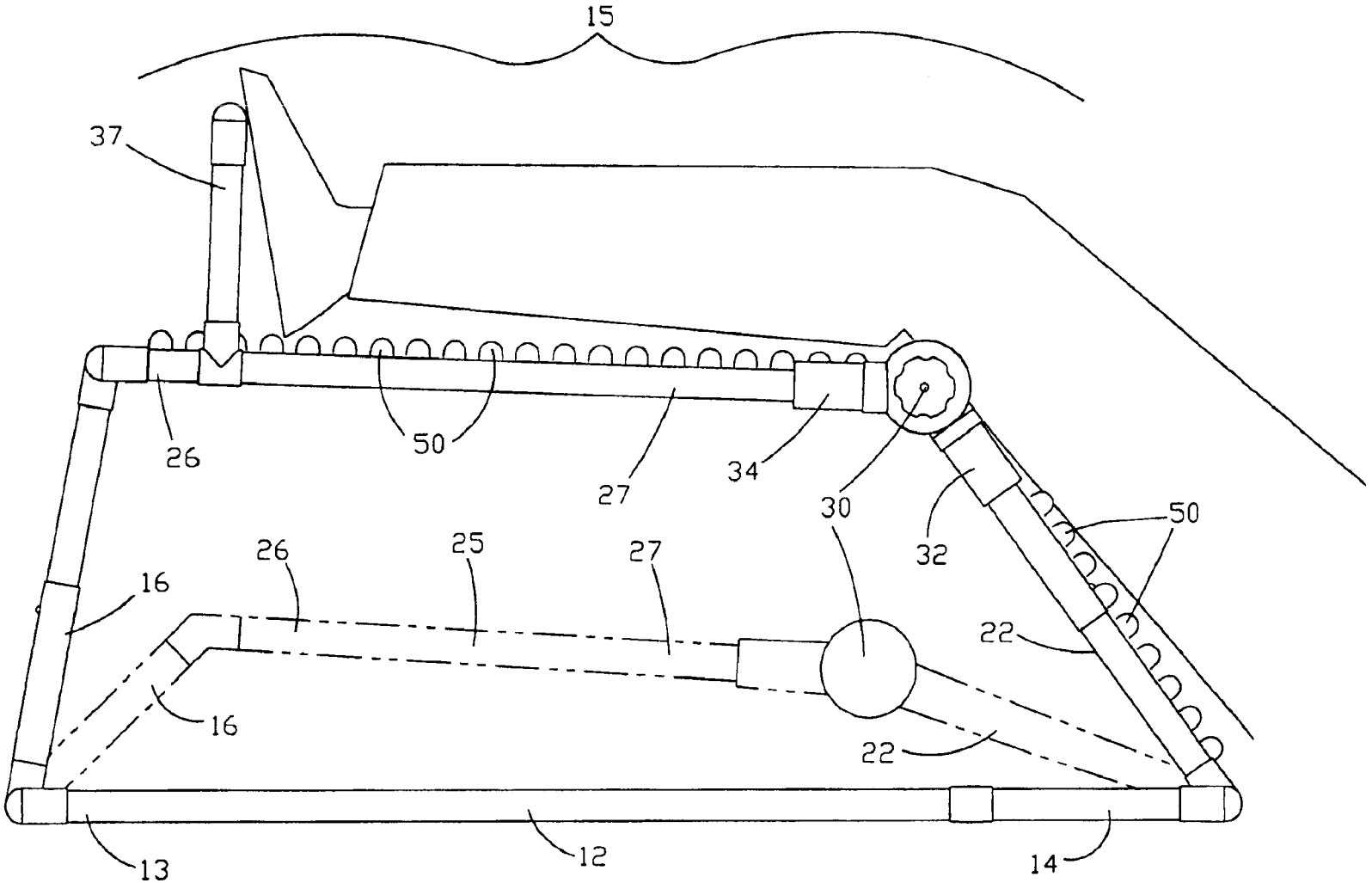
FIG. 5 is a side view of the leg elevator in use showing different positions achieved using the three independent adjustment mechanisms.

Turning now to FIG. 5, the leg elevator 11 is shown in use with a leg positioned on the leg elevator 11. FIG. 5 is a side view of the leg elevator 11 that demonstrates, using dashed phantom lines, different positions that the leg elevator 11 can be adjusted to in order to provide the desired elevated position. FIG. 5 also shows that an elongated pad 50 can be positioned on top of the upper leg platform 28 and the lower leg platform 29 of the lower leg support 15 and below the person's leg to receive and cushion the leg. While the leg elevator 11 can be utilized without the elongated pad 50, the preferred embodiment includes the elongated pad 50 to provide greater patient comfort when using the leg elevator 11. The elongated pad 50 can be comprised of any cushioning material. The elongated pad 50 of the preferred embodiment is comprised of egg-crate foam that is commonly used on top of mattresses. The egg-crate foam has elevated portions and depressed portions that provide cushioning, while also providing a means for ventilation, which makes the material desirable for the elongated pad 50 of the present invention. In one alternative use of the leg elevator 11 (not shown), the patient places the entire leg elevator 11 under a mattress, using the mattress as the cushioning material to receive the leg. Another alternative use of the leg elevator 11 (not shown) involves placing the leg elevator 11 under a mattress, such that the leg elevator 11 is used to elevate the upper portion of a person's body in a semi-reclining position.

Referring still to FIG. 5, the leg elevator 11 is for use with a person sitting or lying prone with the leg elevated in a position such that the underside of the calf and the underside of the thigh are resting on the upper leg platform 28 and the lower leg platform 29 of the leg elevator 11 and the foot of the person extends upward from the lower leg platform 29 and rests against the foot support 37. The upper leg adjustment mechanism 22 should be moved to a position that places the angle adjustment mechanism 30 generally under the knee joint of the person when the leg elevator 11 is in use.

FIG. 5 shows the lower leg support frame 25, which has a first end 26 above the lower leg end 13 of the base 12 and a second end 27 near the angle adjustment mechanism 30. The second end 27 of the lower leg support frame 25 is connected to the second end 34 of the angle adjustment mechanism 30. The upper leg adjustment mechanism 22 is connected to the upper leg end 14 of the base 12. The upper leg adjustment mechanism 22 is also connected to the first end 32 of the angle adjustment mechanism 30. FIG. 5 also shows (using phantom lines) that the elevation of the leg elevator 11 can be varied by adjusting the height adjustment mechanism 16. The distance between the lower leg platform 29 and the lower leg support frame 25, which comprise the lower leg support 15, and the upper leg end 14 of the base 12 can be adjusted by changing the position of the upper leg adjustment mechanism 22. Finally, the phantom lines in FIG. 5 show that the relative angular orientation of the lower leg support 15 and the upper leg platform 28 can be varied by adjusting the angle adjustment mechanism 30.

Figure 6:
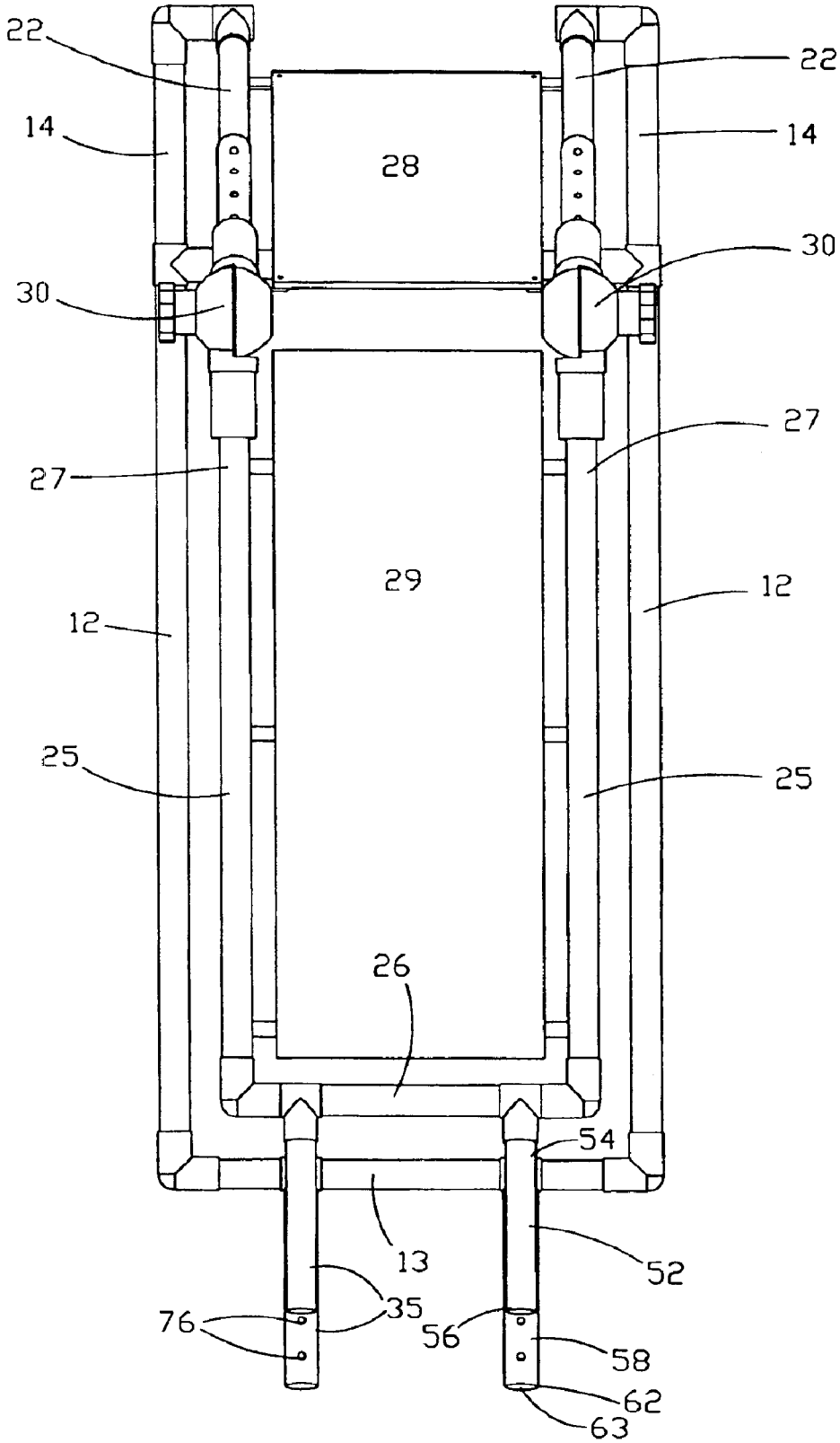
FIG. 6 is a plan view of the leg elevator in a collapsed position.

FIG. 6 is plan or top view of the leg elevator 11 in a collapsed position that is relatively flat and is useful for storage or transport of the leg elevator 11. To achieve this substantially flat position of the leg elevator 11, the height adjustment mechanism 16, which in the preferred embodiment is comprised of a first telescopic leg 38 and a second telescopic leg 40, can be disengaged. The first substantially hollow section 52 of a telescopic leg 35 is separated from the second substantially hollow section 58 of a telescopic leg 35, and the angle adjustment mechanism 30 is moved to a position such that the angle is relatively flat. Therefore, the leg elevator 11 as a whole is substantially flat, which makes storage and transport easier.

FIG. 6 also shows that the first substantially hollow section 52 of a telescopic leg 35 has a first end 54 and a second end 56. The second substantially hollow section 58 also has a first end 60 (not shown in this view) and a second end 62, with the second end 62 of the second substantially hollow section 58 defining an opening 63 to telescopically receive the second end 56 of the first substantially hollow section 52. A telescopic leg 35 of the preferred embodiment also includes a means for retaining the first substantially hollow section 52 in a desired position relative to the second substantially hollow section 58. Referring still to FIG. 6, from top to bottom, the upper leg adjustment mechanism 22, the upper leg end 14 of the base 12, the upper leg platform 28, the angle adjustment mechanism 30, the second end 27 of the lower leg support frame 25, the lower leg support platform 29, the first end 26 of the lower leg support frame 25, the lower leg end 13 of the base 12, and the plurality of apertures 76 in the second substantially hollow section 58 are also depicted.

Figure 7:
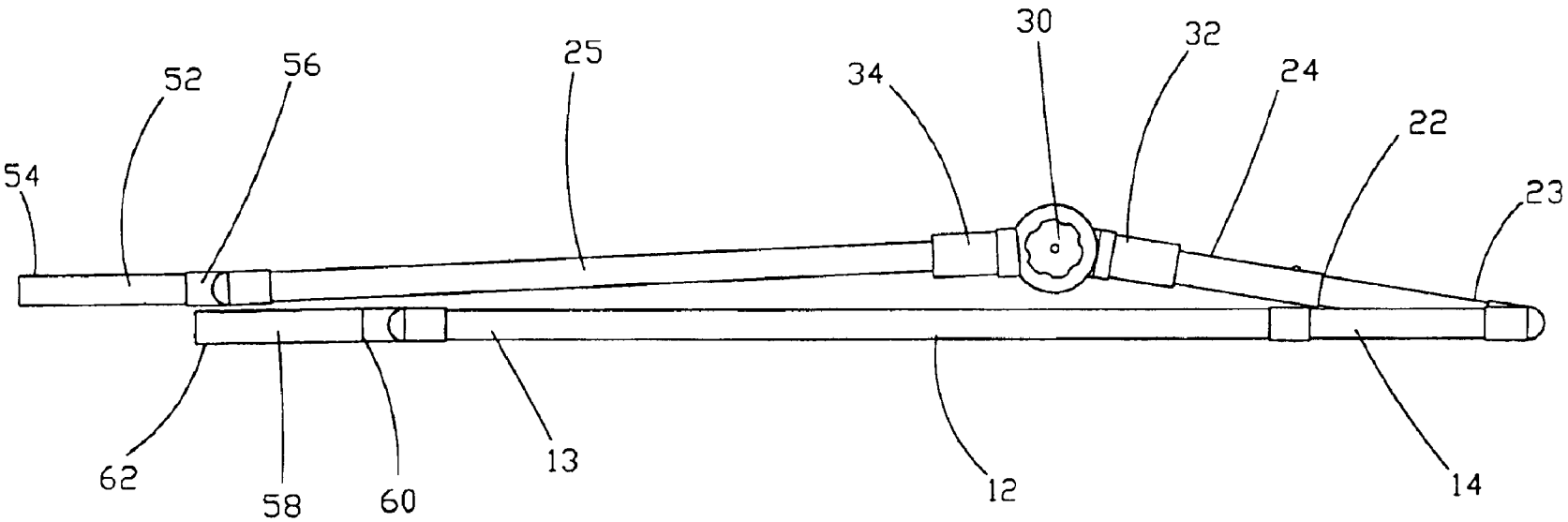
FIG. 7 is a side view of the leg elevator in a collapsed position.

FIG. 7 is a side view of the leg elevator 11 in a collapsed position as shown in FIG. 6. FIG. 7 illustrates that the leg elevator 11 is substantially flat when collapsed. FIG. 7 also shows, from left to right, the first end 54 and the second end 56 of the first substantially hollow section 52, the first end 60 and the second end 62 of the second substantially hollow section 58, the lower leg end 13 of the base 12, the lower leg support frame 25, the second end 34 and the first end 32 of the angle adjustment mechanism 30, the second end 24 and the first end 23 of the upper leg adjustment mechanism 22, and the upper leg end 14 of the base 12.

Figure 8:
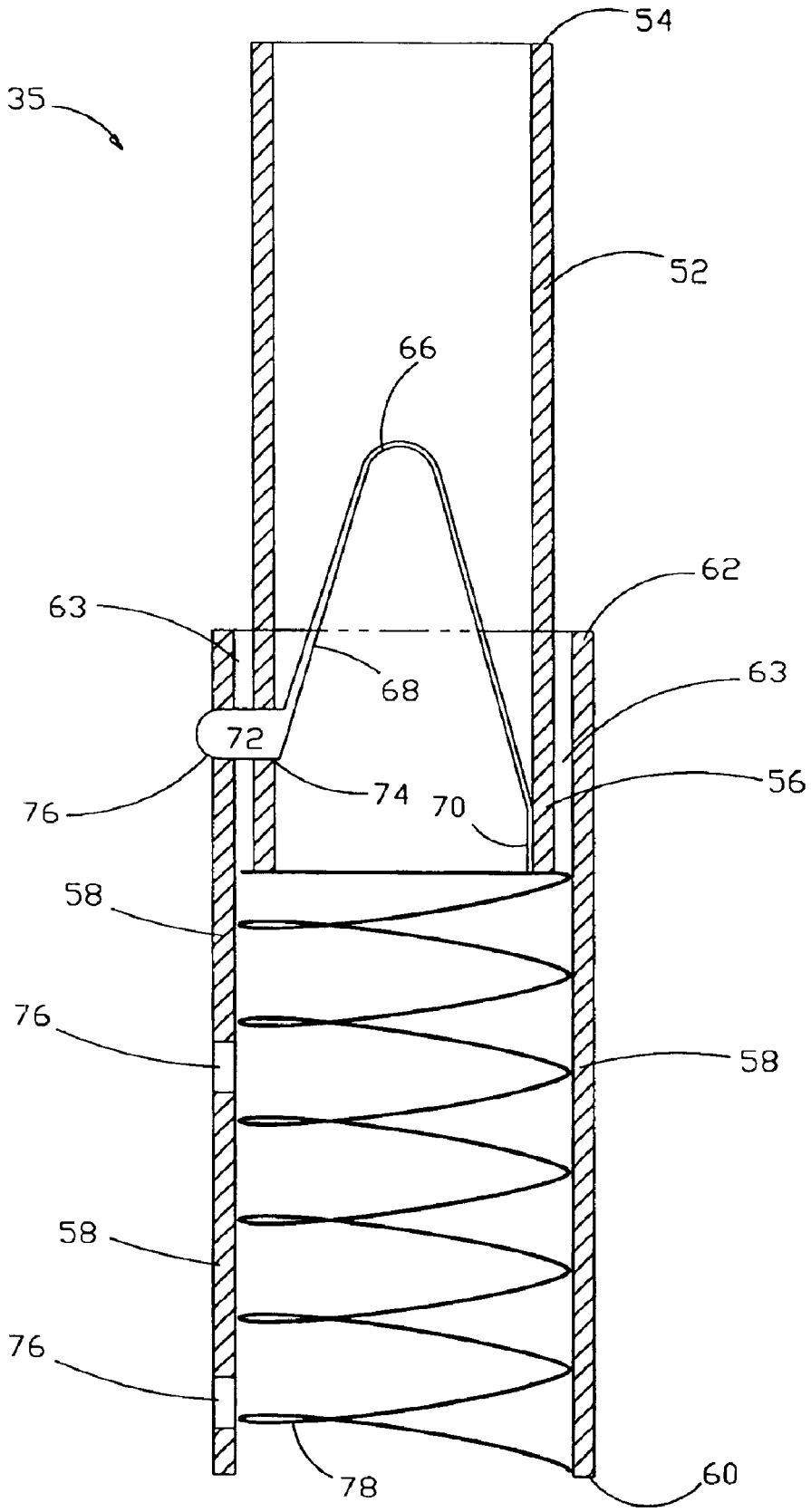
FIG. 8 is a cut away view of a telescopic leg.

Referring now to FIG. 8, a cut-away view of a telescopic leg 35 is shown. A telescopic leg 35 of the preferred embodiment includes a first substantially hollow section 52 that has a first end 54 and a second end 56. A telescopic leg 35 also has a second substantially hollow section 58 with a first end 60 and a second end 62. The second end 62 of the second substantially hollow section 58 defines an opening 63 to telescopically receive the second end 56 of the first substantially hollow section 52. Also, the telescopic leg 35 includes a means for retaining the first substantially hollow section 52 in a desired position relative to the second substantially hollow section 58.

In the preferred embodiment, the means for retaining the first substantially hollow section 52 in a desired position relative to the second substantially hollow section 58 is a U-shaped member 66 that is positioned inside the second end 56 of the first substantially hollow section 52. The U-shaped member 66 has a first end 68 and second end 70. The first end 68 of the U-shaped member 66 has a raised portion 72, and the second end 70 of the U-shaped member 66 is adapted to frictionally engage an inside surface of the second end 56 of the first substantially hollow section 52. In the preferred embodiment, the first substantially hollow section 52 also includes an aperture 74 near the second end 56 of the first substantially hollow section 52. The aperture 74 in the first substantially hollow section 52 receives the raised portion 72 of the U-shaped member 66. In the preferred embodiment, the second substantially hollow section 58 has a plurality of apertures 76 along a length of the second substantially hollow section 58. The plurality of apertures 76 in the second substantially hollow section 58 receive the raised portion 72 of the U-shaped member 66 which extends through the aperture 74 in the second end 56 of the first substantially hollow section 52. As shown near the bottom of FIG. 8, a spring 78 can be positioned inside the telescopic leg 35. The spring 78 moves the telescopic leg 35 into an extended position when the first substantially hollow section 52 and the second substantially hollow section 58 are telescopically engaged.

In the present invention, at least one telescopic leg is used for the height adjustment mechanism 16 and for the upper leg adjustment mechanism 22. Although the leg elevator 11 is operable with telescopic leg 35 acting as the height adjustment mechanism 16, the preferred embodiment utilizes a first telescopic leg 38 for adjusting a height of the lower leg support frame 25 above the base 12 and a second telescopic leg 40 for adjusting the height of the lower leg support frame 25 above the base 12. Using two telescopic legs for the height adjustment mechanism 16 provides the leg elevator 11 with more strength and stability in holding the proper elevation positions. In the preferred embodiment, the upper leg adjustment mechanism 22 includes a third telescopic leg 42 for adjusting a distance between the upper leg end 14 of the base 12 and the lower leg support frame 25 and a fourth telescopic leg 44 for adjusting a distance between the upper leg end 14 of the base 12 and the lower leg support frame 25. Each telescopic leg 35 is comprised as detailed above and is operated as described below.

To adjust a telescopic leg 35 the raised portion 72 of the U-shaped member 66 is moved to a position near the first end 70 of the U-shaped member 66, creating tension in the U-shaped member 66 by placing the first end 68 and the second end 70 of the U-shaped member 66 in close proximity to one another. The raised portion 72 of the U-shaped member 66 should be depressed far enough to disengage the raised portion 72 of the U-shaped member 66 from one of the plurality of apertures 76 in the second substantially hollow section 58. A telescopic leg 35 can then be repositioned by sliding the first substantially hollow section 52 in a linear telescopic fashion relative to the second substantially hollow section 58 until the raised portion 72 of the U-shaped member 66, which extends from the aperture 74 defined by the second end 56 of the first substantially hollow section 52, engages another aperture in the plurality of apertures 76 in the second substantially hollow section 58. The spring 78, positioned inside a telescopic leg 35, can be used to help move the first substantially hollow section 52 in a telescopic fashion relative to the second substantially hollow section 58 when the telescopic leg 35 is adjusted.

Figure 9:
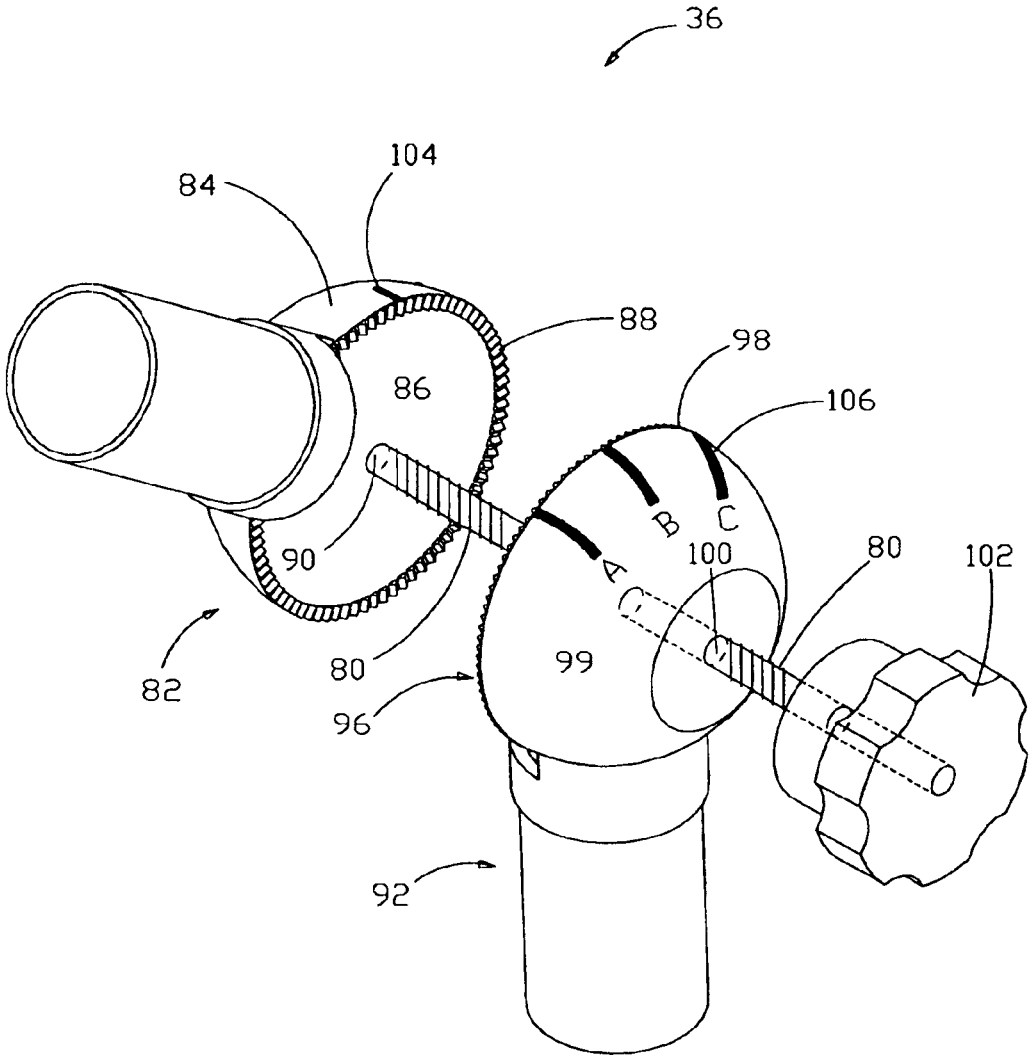
FIG. 9 is an exploded view of a ball-ratchet mechanism.

Turning now to FIG. 9, the ball-ratchet mechanism 36 is shown in an exploded, detailed view. The angle adjustment mechanism 30 of the leg elevator 11 includes at least one ball-ratchet mechanism 36 as shown in FIG. 9. In the preferred embodiment, the angle adjustment mechanism 30 includes a first ball-ratchet mechanism 45 and a second ball-ratchet mechanism 46. Each ball-ratchet mechanism is formed in the manner detailed below.

A ball-ratchet mechanism 36 of the preferred embodiment includes an elongated threaded connector 80, a first grooved member 82, a second grooved member 92 and a knob 102. The first grooved member 82 has an outer side 84 and an inner side 86. The first grooved member 82 also has a first plurality of grooves 88 formed on the inner side 86 of the first grooved member 82. A first threaded opening 90 originates at the inner side 86 of the first grooved member 82 and extends through the first grooved member 82. The first threaded opening 90 receives the elongated threaded connector 80. The second grooved member 92 has an outer side 94 and an inner side 96 (indicated by an arrow, but not shown). The second grooved member 92 also has a second plurality of grooves 98 formed on the inner side 96 of the second grooved member 92. The second plurality of grooves 98 is adapted to engage the first plurality of grooves 88. A second threaded opening 100 originates at the outer side 94 of the second grooved member 92 and extends through the second grooved member 92 to the inner side 96 of the second grooved member 92. The second threaded opening 100 receives the elongated threaded connector 80. The knob 102 is attached to the elongated threaded connector 80 for rotating the elongated threaded connector 80 as the elongated threaded connector 80 engages the first threaded opening 90 and the second threaded opening 100. The knob 102 is used to move the elongated threaded connector 80 between a locking position where the first plurality of grooves 88 and the second plurality of grooves 98 are held in engagement with each other and an unlocked position where the first plurality of grooves 88 and the second plurality of grooves 98 can be angularly adjusted with respect to each other.

While the preferred embodiment utilizes a ball-ratchet mechanism 36 for the angle adjustment mechanism 30, other mechanisms such as a hinge, a rotatable T-connector that is secured by a pin, or a clamping device could be utilized in the leg elevator 11 of the present invention. The ball-ratchet mechanism 36 is preferable, though, because it can be adjusted without requiring the patient to remove his or her leg from the leg elevator 11, and adjustment of the angle adjustment mechanism 30 can be performed by the patient without additional assistance. Furthermore, using the ball-ratchet mechanism, the relative angle of the upper leg platform 28 and lower leg support 15 can be adjusted without varying the height adjustment mechanism 16 or the upper leg adjustment mechanism 22 of the leg elevator 11 due to the independence of the angle adjustment mechanism 30 relative to the height adjustment mechanism 16 and the upper leg adjustment mechanism 22. The ball-ratchet mechanism 36 is also preferred due to the ease it provides in varying the position of the elevator and in reproducing a preferred or physician specified angular orientation of the upper leg platform 28 to the lower leg platform 29. Alternatively, the patient can simply adjust the leg elevator 11 to position the leg in any manner that is comfortable to the patient. To further aid in achieving a desired position of the angle adjustment mechanism 30, a ball-ratchet mechanism 36 preferably includes a plurality of markings 104 on the outer side 84 of the first grooved member 82 and a plurality of markings 106 on the outer side 94 of the second grooved member 92. The plurality of markings 106 on the outer side 94 of the second grooved member 92 can be adapted to align with the plurality of markings 104 on the outer side 84 of the first grooved member 82.

To adjust a ball-ratchet mechanism 36 as shown in FIG. 9, the knob 102 is turned such that the elongated threaded connector 80, which is threadably engaged with the first grooved member 82 via the first threaded opening 90 and with the second grooved member 92 via the second threaded opening 100, moves away from the first grooved member 82. Turning the knob 102 as described will cause the first plurality of grooves 88 on the inner side 86 of the first grooved member 82 and the second plurality of grooves 98 on the inner side 96 of the second grooved member 92 to disengage. This is the unlocked position. While in the unlocked position, the first grooved member 82 can be twisted relative to the second grooved member 92, thereby adjusting the relative angle of the upper leg platform 28 and the lower leg platform 29. When the desired angle has been achieved, the knob 102 is turned in the opposite direction, causing the elongated threaded connector 80 to re-engage the first threaded opening 90 in the first grooved member 82. Turning the elongated threaded connector 80 as described will bring the first grooved member 82 closer in proximity to the second grooved member 92 such that by turning the knob 102, the first plurality of grooves 88 will be held in engagement with the second plurality of grooves 98, and the angle adjustment mechanism 30 will be held in a stable position.

The preferred embodiment of the leg elevator 11 is comprised of lightweight plastic tubing such as PVC (polyvinyl chloride) pipe. Using PVC pipe to manufacture the leg elevator 11 of the preferred embodiment creates a leg elevator 11 that is relatively inexpensive and easy to manufacture, which allows the device to be affordable for use in a home setting. However, other material could be used to construct the leg elevator 11. For example, lightweight aluminum could be substituted for the PVC pipe without altering the material features of the present invention. Additionally, the lightweight plastic parts of the telescopic leg 35 of the leg elevator 11 can be formed of round tubing or alternatively, of square or octagonal-shaped pieces.

Many modifications and variations of the present invention are possible in light of the above teachings. For example, although the preferred embodiment utilizes a base 12 and support platforms 28, 29 which are adapted to be wide enough to support one leg at a time, the leg elevator 11 could be adapted such that the leg elevator 11 is wide enough to accommodate the support of both legs at one time. Therefore, within the scope of the appended claims, the present invention may be practiced otherwise than as specifically described, and the present invention has been described in an illustrative manner only. It is to be understood that the terminology that has been used is intended to be in the nature of words description rather than of limitation. It will be understood by those skilled in the art the various changes and modifications can be made about departing from the scope of the invention as defined in the appended claims.

What is claimed is:

1. A leg elevator comprising:

a base having a lower leg end and an upper leg end;

a lower leg support;

a height adjustment mechanism between said lower leg end of said base and said lower leg support for adjusting a height of said lower leg support above said base;

an upper leg adjustment mechanism operably connected to said upper leg end of said base for adjusting a distance between said upper leg end of said base and said lower leg support, said upper leg adjustment mechanism comprising a telescopic leg having a first substantially hollow section having a first end and a second end, a second substantially hollow section having a first end and a second end, said second end of said second substantially hollow section defining an opening to telescopically receive said second end of said first substantially hollow section, and a means for retaining said first substantially hollow section telescopically in a desired position relative to said second substantially hollow section;

an upper leg platform supported by said upper leg adjustment mechanism; and an angle adjustment mechanism between said upper leg adjustment mechanism and said lower leg support for adjusting a relative angular orientation of said upper leg platform relative to said lower leg support, said angle adjustment mechanism having a ball-ratchet mechanism providing a releasable fixed resistance at a variable angle for adjusting said relative angular orientation of said upper leg platform relative to said lower leg support frame, said ball-ratchet mechanism having an elongated threaded connector.

2. The leg elevator of claim 1 further comprising a spring positioned inside said telescopic leg to move said telescopic leg into an extended position when said first substantially hollow section and said second substantially hollow section are telescopically engaged.

3. The leg elevator of claim 1 wherein:

said means for retaining said first substantially hollow section telescopically in a desired position relative to said second substantially hollow section is a U-shaped member positioned inside said second end of said first substantially hollow section, said U-shaped member having a first end with a raised portion and a second end adapted to frictionally engage an inside surface of said second end of said first substantially hollow section;

said first substantially hollow section including an aperture near said second end of said first substantially hollow section for receiving said raised portion of said U-shaped member; and said second substantially hollow section having a plurality of apertures along a length of said second substantially hollow section for receiving said raised portion of said U-shaped member extending through said aperture in said first substantially hollow section.

4. A leg elevator comprising:

a base having a lower leg end and an upper leg end;

a lower leg support frame having a first end and a second end;

a lower leg platform connected to said lower leg support frame;

a height adjustment mechanism having a telescopic leg for adjusting a height of said lower leg support frame above said base, said height adjustment mechanism having a first end and a second end, said first end of said height adjustment mechanism being operably connected to said lower leg end of said base and said second end of said height adjustment mechanism being operably attached to said first end of said lower leg support frame;

an upper leg adjustment mechanism having a telescopic leg for adjusting a distance between said upper leg end of said base and said second end of said lower leg support frame, said upper leg adjustment mechanism having a first end and a second end, said first end of said upper leg adjustment mechanism being operably connected to said upper leg end of said base;

each of said telescopic legs having a first substantially hollow section with a first end and a second end, a second substantially hollow section with a first end and a second end, said second end of said second substantially hollow section defining an opening to telescopically receive said second end of said first substantially hollow section, and a means for retaining said first substantially hollow section telescopically in a desired position relative to said second substantially hollow section;

an upper leg platform supported by said upper leg adjustment mechanism; and an angle adjustment mechanism having a ball-ratchet mechanism for adjusting a relative angular orientation of said upper leg platform relative to said lower leg support frame, said angle adjustment mechanism having a first end and a second end, said first end of said angle adjustment mechanism being operably attached to said second end of said upper leg adjustment mechanism and said second end of said angle adjustment mechanism being operably attached to said second end of said lower leg support frame;

said ball-ratchet mechanism having an elongated threaded connector, a first grooved member with an outer side and an inner side, a first plurality of grooves formed on said inner side of said first grooved member, a first threaded opening originating at said inner side of said first grooved member and extending through said first grooved member for receiving said elongated threaded connector, a second grooved member with an outer side and an inner side, a second plurality of grooves formed on said inner side of said second grooved member, said second plurality of grooves being adapted to engage said first plurality of grooves, a second threaded opening originating at said outer side of said second grooved member and extending through said second grooved member to said inner side of said second grooved member for receiving said elongated threaded connector, and a knob operably attached to said elongated threaded connector for rotating said elongated threaded connector as said elongated threaded connector engages said first threaded opening and said second threaded opening, said knob being usable to move said elongated threaded connector between a locking position wherein said first and said second plurality of grooves are held in engagement with each other and an unlocked position wherein said first and said second grooved members can be angularly adjusted with respect to each other.

5. The leg elevator of claim 4 further comprising a foot support connected to and extending from said lower leg support frame, such that said foot support engages and positions a foot when a heel portion of the foot rests on said lower leg platform and a toe portion of the foot is above said heel portion of the foot.

6. The leg elevator of claim 4 further comprising an elongated pad adapted to be positioned on top of said upper leg platform and on top of said lower leg platform such that the pad is adapted to receive and cushion a leg.

7. The leg elevator of claim 4 wherein said leg elevator is comprised of lightweight plastic tubing.

8. The leg elevator of claim 4 wherein said upper leg platform comprises a length of material operably supported by said upper leg adjustment mechanism forming a sling to receive and support an upper leg.

9. The leg elevator of claim 4 wherein said lower leg platform comprises a length of material operably suspended from said lower leg support frame forming a sling to receive and support a lower leg.

10. The leg elevator of claim 4 further comprising a spring positioned inside each of said telescopic legs to move said telescopic legs into an extended position when said first substantially hollow sections and said second substantially hollow sections are telescopically engaged.

11. The leg elevator of claim 4 wherein:

said means for retaining said first substantially hollow section telescopically in a desired position relative to said second substantially hollow section is a U-shaped member positioned inside the second end of said first substantially hollow section, said U-shaped member having a first end with a raised portion and a second end adapted to frictionally engage an inside surface of said second end of said first substantially hollow section;

said first substantially hollow section including an aperture near said second end of said first substantially hollow section for receiving said raised portion of said U-shaped member; and said second substantially hollow section having a plurality of apertures along a length of said second substantially hollow section for receiving said raised portion of said U-shaped member extending through said aperture in said first substantially hollow section.

12. The leg elevator of claim 4 wherein said ball-ratchet mechanism further comprises:

a plurality of markings on said outer side of said first grooved member; and a plurality of markings on said outer side of said second grooved member that are adapted to align with said plurality of markings on said first grooved member.

13. A leg elevator comprising:

a base having a lower leg end and an upper leg end;

a lower leg support frame having a first end and a second end;

a lower leg platform connected to said lower leg support frame;

a first telescopic leg between said lower leg end of said base and said first end of said lower leg support frame for adjusting a height of said lower leg support above said base;

a second telescopic leg between said lower leg end of said base and said first end of said lower leg support frame for adjusting a height of said lower leg support above said base;

a third telescopic leg operably connected to said upper leg end of said base for adjusting a distance between said upper leg end of said base and said lower leg platform;

a fourth telescopic leg operably connected to said upper leg end of said base for adjusting a distance between said upper leg end of said base and said lower leg platform;

an upper leg platform between said third telescopic leg and said fourth telescopic leg;

a first ball-ratchet mechanism operably connected between said second end of said lower leg support frame and said third telescopic leg; and a second ball-ratchet mechanism operably connected between said second end of said lower leg support frame and said fourth telescopic leg.

14. The leg elevator of claim 13 wherein said ball-ratchet mechanisms each comprise:

an elongated threaded connector;

a first grooved member having an outer side and an inner side;

a first plurality of grooves formed on said inner side of said first grooved member;

a first threaded opening originating at said inner side of said first grooved member and extending through said first grooved member for receiving said elongated threaded connector;

a second grooved member having an outer side and an inner side;

a second plurality of grooves formed on said inner side of said second grooved member, said second plurality of grooves being adapted to engage said first plurality of grooves;

a second threaded opening originating at said outer side of said second grooved member and extending through said second grooved member to said inner side of said second grooved member for receiving said elongated threaded connector; and a knob operably attached to said elongated threaded connector for rotating said elongated threaded connector as said elongated threaded connector engages said first threaded opening and said second threaded opening, said knob being usable to move said elongated threaded connector between a locking position wherein said first and said second plurality of grooves are held in engagement with each other and an unlocked position wherein said first and said second grooved members can be angularly adjusted with respect to each other.

15. The leg elevator of claim 13 wherein said telescopic legs each comprise:

a first substantially hollow section with a first end and a second end;

a second substantially hollow section having a first end and a second end, said second end of said second substantially hollow section defining an opening to telescopically receive said second end of said first substantially hollow section; and a means for retaining said first substantially hollow section telescopically in a desired position relative to said second substantially hollow section.

16. The leg elevator of claim 15 wherein said ball-ratchet mechanisms each comprise:

an elongated threaded connector;

a first grooved member having an outer side and an inner side;

a first plurality of grooves formed on said inner side of said first grooved member;

a first threaded opening originating at said inner side of said first grooved member and extending through said first grooved member for receiving said elongated threaded connector;

a second grooved member having an outer side and an inner side;

a second plurality of grooves formed on said inner side of said second grooved member, said second plurality of grooves being adapted to engage said first plurality of grooves;

a second threaded opening originating at said outer side of said second grooved member and extending through said second grooved member to said inner side of said second grooved member for receiving said elongated threaded connector; and a knob operably attached to said elongated threaded connector for rotating said elongated threaded connector as said elongated threaded connector engages said first threaded opening and said second threaded opening, said knob being usable to move said elongated threaded connector between a locking position wherein said first and said second plurality of grooves are held in engagement with each other and an unlocked position wherein said first and said second grooved members can be angularly adjusted with respect to each other.

17. The leg elevator of claim 13 further comprising a foot support connected to and extending from said lower leg support frame, such that said foot support engages and positions a foot when a heel portion of the foot rests on said lower leg platform and a toe portion of the foot is above said heel portion of the foot.

18. The leg elevator of claim 15 wherein:

said means for retaining said first substantially hollow section telescopically in a desired position relative to said second substantially hollow section is a first U-shaped member positioned inside the second end of said first substantially hollow section, said first U-shaped member having a first end with a raised portion and a second end adapted to frictionally engage an inside surface of said second end of said first substantially hollow section;

said first substantially hollow section including an aperture near said second end of said first substantially hollow section for receiving said raised portion of said first U-shaped member; and said second substantially hollow section having a plurality of apertures along a length of said second substantially hollow section for receiving said raised portion of said first U-shaped member extending through said aperture in said first substantially hollow section.

19. The leg elevator of claim 15 further comprising a spring positioned inside each of said telescopic legs to move said telescopic legs into an extended position when said first substantially hollow sections and said second substantially hollow sections are telescopically engaged.

20. The leg elevator of claim 16 wherein said ball-ratchet mechanisms each further comprise:

a plurality of markings on said outer side of said first grooved member; and a plurality of markings on said outer side of said second grooved member that are adapted to align with said plurality of markings on said first grooved member.

21. The leg elevator of claim 13 wherein said leg elevator is made of lightweight, plastic tubing.

22. A leg elevator comprising:

a base having a lower leg end and an upper leg end;

a lower leg support;

a height adjustment mechanism between said lower leg end of said base and said lower leg support for adjusting a height of said lower leg support above said base, said height adjustment mechanism comprising a telescopic leg;

an upper leg adjustment mechanism operably connected to said upper leg end of said base for adjusting a distance between said upper leg end of said base and said lower leg support, said upper leg adjustment mechanism comprising a telescopic leg;

an upper leg platform supported by said upper leg adjustment mechanism;

an angle adjustment mechanism between said upper leg adjustment mechanism and said lower leg support for adjusting a relative angular orientation of said upper leg platform relative to said lower leg support, said angle adjustment mechanism having a ball-ratchet mechanism providing a releasable fixed resistance at a variable angle for adjusting said relative angular orientation of said upper leg platform relative to said lower leg support frame, said ball-ratchet mechanism having an elongated threaded connector; and wherein each of said telescopic legs comprises a first substantially hollow section having a first end and a second end, a second substantially hollow section having a first end an a second end, said second end of said second substantially hollow section defining an opening to telescopically receive said second end of said first substantially hollow section, and a means for retaining said first substantially hollow section telescopically in a desired position relative to said second substantially hollow section.

23. The leg elevator of claim 22 wherein said angle adjustment mechanism comprises a ball-ratchet mechanism.

24. The leg elevator of claim 23 wherein said ball-ratchet mechanism comprises:

an elongated threaded connector;

a first grooved member having an outer side and an inner side;

a first plurality of grooves formed on said inner side of said first grooved member;

a first threaded opening originating at said inner side of said first grooved member and extending through said first grooved member for receiving said elongated threaded connector;

a second grooved member having an outer side and an inner side;

a second plurality of grooves formed on said inner side of said second grooved member, said second plurality of grooves being adapted to engage said first plurality of grooves;

a second threaded opening originating at said outer side of said second grooved member and extending through said second grooved member to said inner side of said second grooved member for receiving said elongated threaded connector; and a knob operably attached to said elongated threaded connector for rotating said elongated threaded connector as said elongated threaded connector engages said first threaded opening and said second threaded opening, said knob being usable to move said elongated threaded connector between a locking position wherein said first and said second plurality of grooves are held in engagement with each other and an unlocked position wherein said first and said second grooved members can be angularly adjusted with respect to each other.

25. A leg elevator comprising:

a base having lower leg end and an upper leg end;

a lower leg support;

a height adjustment mechanism between said lower leg end of said base and said lower leg support for adjusting a height of said lower leg support above said base, said height adjustment mechanism comprising a telescopic leg having a first substantially hollow section having a first end and a second end, a second substantially hollow section having a first end and a second end, said second end of said second substantially hollow section defining an opening to telescopically receive said second end of said first substantially hollow section, and a means for retaining said first substantially hollow section telescopically in a desired position relative to said second substantially hollow section;

an upper leg adjustment mechanism operably connected to said upper leg end of said base for adjusting a distance between said upper leg end of said base and said lower leg support;

an upper leg platform supported by said upper leg adjustment mechanism; and an angle adjustment mechanism between said upper leg adjustment mechanism and said lower leg support for adjusting a relative angular orientation of said upper leg platform relative to said lower leg support, said angle adjustment mechanism having a ball-ratchet mechanism providing a releasable fixed resistance at a variable angle for adjusting said relative angular orientation of said upper leg platform relative to said lower leg support frame, said ball-ratchet mechanism having an elongated threaded connector.

26. The leg elevator of claim 25 further comprising a spring positioned inside said telescopic leg to move said telescopic leg into an extended position when said first substantially hollow section and said second substantially hollow section are telescopically engaged.

27. The leg elevator of claim 25 wherein:

said means for retaining said first substantially hollow section telescopically in a desired position relative to said second substantially hollow section is a U-shaped member positioned inside said second end of said first substantially hollow section, said U-shaped member having a first end with a raised portion and a second end adapted to frictionally engage an inside surface of said second end of said first substantially hollow section;

said first substantially hollow section including an aperture near said second end of said first substantially hollow section for receiving said raised portion of said U-shaped member; and said second substantially hollow section having a plurality of apertures along a length of said second substantially hollow section for receiving said raised portion of said U-shaped member extending through said aperture in said first substantially hollow section.

28. A leg elevator comprising:

a base having a lower leg end and an upper leg end;

a lower leg support;

a height adjustment mechanism between said lower leg end of said base and said lower leg support for adjusting a height of said lower leg support above said base;

an upper leg adjustment mechanism operably connected to said upper leg end of said base for adjusting a distance between said upper leg end of said base and said lower leg support;

an upper leg platform supported by said upper leg adjustment mechanism;

an angle adjustment mechanism between said upper leg adjustment mechanism and said lower leg support for adjusting a relative angular orientation of said upper leg platform relative to said lower leg support, said angle adjustment mechanism having a ball-ratchet mechanism providing a releasable fixed resistance at a variable angle for adjusting said relative angular orientation of said upper leg platform relative to said lower leg support frame, said ball-ratchet mechanism having an elongated threaded connector; and wherein said ball-ratchet mechanism having an elongated threaded connector further comprises a first grooved member having an outer side and an inner side, a first plurality of grooves formed on said inner side of said first grooved member, a first threaded opening originating at said inner side of said first grooved member and extending through said first grooved member for receiving said elongated threaded connector, a second grooved member having an outer side and an inner side, a second plurality of grooves formed on said inner side of said second grooved member, said second plurality of grooves being adapted to engage said first plurality of grooves, a second threaded opening originating at said outer side of said second grooved member and extending through said second grooved member to said inner side of said second grooved member for receiving said elongated threaded connector; and a knob operably attached to said elongated threaded connector for rotating said elongated threaded connector as said elongated threaded connector engages said first threaded opening and said second threaded opening, said knob being usable to move said elongated threaded connector between a locking position wherein said first and said second plurality of grooves are held in engagement with each other and an unlocked position wherein said first and said second grooved members can be angularly adjusted with respect to each other.

29. The leg elevator of claim 28 wherein said ball-ratchet mechanism further comprises:

a plurality of markings on said outer side of said first grooved member; and a plurality of markings on said outer side of said second grooved member that are adapted to align with said plurality of markings on said first grooved member.

* * * * *

UNITED STATES PATENT AND TRADEMARK OFFICE

CERTIFICATE OF CORRECTION

PATENT NO. : 6,935,992 B2
APPLICATION NO. : 10/001125
DATED : August 30, 2005
INVENTOR(S) : Jon C. Gehrke It is certified that error appears in the above-identified patent and that said Letters Patent is hereby corrected as shown below:

Title page, item [73], should read as follows:

Assignee: Innovative Ellavations, Clive, IA (US)

Signed and Sealed this
Twenty-eighth Day of June, 2011

David J. Kappos

David J. Kappos
*Director of the United States Patent and Trademark Office*